US012534239B2

(12) United States Patent
Nannetti

(10) Patent No.: US 12,534,239 B2
(45) Date of Patent: Jan. 27, 2026

(54) METHOD AND A SYSTEM FOR MANAGING THE SERIALISATION AND TRACING OF PACKS OF PRODUCTS TO BE GROUPED AND INSERTED IN A RESPECTIVE CONTAINER

(71) Applicant: MARCHESINI GROUP S.P.A., Pianoro (IT)

(72) Inventor: Simone Nannetti, Grizzana Morandi (IT)

(73) Assignee: MARCHESINI GROUP S.P.A., Pianoro (IT)

( * ) Notice: Subject to any disclaimer, the term of this patent is extended or adjusted under 35 U.S.C. 154(b) by 0 days.

(21) Appl. No.: 18/855,324

(22) PCT Filed: Apr. 13, 2023

(86) PCT No.: PCT/IB2023/053774
§ 371 (c)(1),
(2) Date: Oct. 9, 2024

(87) PCT Pub. No.: WO2023/199253
PCT Pub. Date: Oct. 19, 2023

(65) Prior Publication Data

US 2025/0250037 A1 Aug. 7, 2025

(30) Foreign Application Priority Data

Apr. 15, 2022 (IT) ..... 102022000007592

(51) Int. Cl.
*B65B 5/06* (2006.01)
*B65B 35/40* (2006.01)
(Continued)

(52) U.S. Cl.
CPC ..... *B65B 5/06* (2013.01); *B65B 35/405* (2013.01); *B65B 35/54* (2013.01); *B65B 57/12* (2013.01);
(Continued)

(58) Field of Classification Search
CPC . B65B 2210/04; B65B 2220/16; B65B 35/16; B65B 35/24; B65B 35/405;
(Continued)

(56) References Cited

U.S. PATENT DOCUMENTS

2004/0217993 A1* 11/2004 Itoh ..... B41J 3/4073 347/2
2006/0099334 A1* 5/2006 O'Brien ..... C03C 17/002 427/163.1
(Continued)

FOREIGN PATENT DOCUMENTS

WO 2009040261 4/2009

OTHER PUBLICATIONS

"International Search Report (Form PCT/ISA/210) of PCT/IB2023/053774", mailed on Sep. 14, 2023, pp. 1-2.

*Primary Examiner* — Himchan Song
(74) *Attorney, Agent, or Firm* — JCIPRNET

(57) ABSTRACT

The method for managing the serialisation and tracing of packs of products, which are to be gathered in groups of packs to be inserted in respective containers, comprises: picking up, from a first conveyor means (1), a first series of packs of products (P) for which a respective series of reference codes (a, b, c) present thereon has been collected and memorised, and forming a group (P1, P2) of packs of products internally of a seat (21, 22) of the second conveyor means (2), memorising the position of the seat (21, 22) on the second conveyor means (2) and transferring the seat (21, 22) to a transfer station (ST); using a third conveyor means
(Continued)

(3) for transferring a container (A1, A2) into the transfer station (ST) and transferring the group (P1, P2) of packs of products for which the reference codes have been memorised from the seat (21, 22) of the conveyor means (2) into the container (A1, A2), The method further comprises, before or after transferring the group (P1, P2) of packs of products into the second container (A1, A2), applying on the container (A1 A2) a tracing code bearing a datum representing the reference codes which had been memorised and which are present in the packs of products of the second group (P1, P2) of packs of products.

13 Claims, 1 Drawing Sheet

(51) Int. Cl.

| | |
|---|---|
| ***B65B 35/54*** | (2006.01) |
| ***B65B 57/12*** | (2006.01) |
| ***B65B 57/14*** | (2006.01) |
| ***B65B 61/02*** | (2006.01) |
| ***B65B 61/26*** | (2006.01) |

(52) U.S. Cl.
CPC ..... *B65B 57/14* (2013.01); *B65B 61/025* (2013.01); *B65B 61/26* (2013.01); *B65B 2220/16* (2013.01)

(58) Field of Classification Search
CPC ..... B65B 35/44; B65B 35/52; B65B 35/54; B65B 43/52; B65B 5/06; B65B 57/12; B65B 57/14; B65B 61/025; B65B 61/26
See application file for complete search history.

(56) References Cited

U.S. PATENT DOCUMENTS

| | | | | |
|---|---|---|---|---|
| 2008/0055348 | A1* | 3/2008 | Deeter | B28B 23/0031 347/107 |
| 2009/0130395 | A1* | 5/2009 | Lyon | C03C 17/001 427/256 |
| 2013/0140745 | A1* | 6/2013 | Preckel | B29C 49/42073 264/503 |
| 2020/0207501 | A1* | 7/2020 | Urquhart | B65B 31/02 |
| 2021/0284374 | A1* | 9/2021 | Toedtli | B65B 61/26 |
| 2023/0091725 | A1* | 3/2023 | Stowitts | B41J 3/4071 347/110 |

* cited by examiner

100
SP
S1
S2
SA
PR
PRC
ST
E
PE
V
SR
P
RR
Z1
Z2
Z3
1
2
3
A1
A2
(21,22)
(P1,P2)
P1
P2

METHOD AND A SYSTEM FOR MANAGING THE SERIALISATION AND TRACING OF PACKS OF PRODUCTS TO BE GROUPED AND INSERTED IN A RESPECTIVE CONTAINER

CROSS-REFERENCE TO RELATED APPLICATION

This application is a 371 application of the International PCT application serial no. PCT/IB2023/053774, filed on Apr. 13, 2023, which claims the priority benefits of Italy Patent Application No. 102022000007592, filed on Apr. 15, 2022. The entirety of each of the above-mentioned patent applications is hereby incorporated by reference herein and made a part of this specification.

FIELD OF THE INVENTION

The present invention relates to the technical sector relating to the packing of products for pharmaceutical, parapharmaceutical, cosmetic or food use internally of respective packages, such as for example blister packs, stickpacks, destined then to be inserted internally of respective containers, such as, for example boxes. In particular, the invention relates to a method and a system for managing the serialisation and tracing of packs of products, of the type described above and packaged in blister packs or stickpacks, which are then to be grouped and inserted in a respective container.

DESCRIPTION OF THE PRIOR ART

It is known that blister packs are obtained by a first strip made of a heat-formable material, in which the seats, or cells, are realised via a heat-forming process, so as to receive respective products, and by a second strip made of a heat-weldable material which is applied and coupled to the first strip to seal the products contained in the seats or cells.

The two strips, once coupled and reciprocally sealed, will be cut to obtain the single blister packs.

For example, the blister packs can be realised so as to contain pharmaceutical, parapharmaceutical, cosmetic products, or are for food use, in the form of tablets, pills or capsules; in this case, in the first strip of heat-weldable material a series of cells are realised, each of which has a suitable shape for internally receiving a respective tablet, pill or capsule.

There are also blister packs realised for packaging products for pharmaceutical use, such as syringes, vials or bottles; in this case, one or more seats will be realised in the first strip of heat-weldable material, which seats have a suitable shape for receiving a syringe, a vial or a bottle.

Usually, blister packs are grouped together, for example stacked one upon another (for example in groups of two or three blister packs, stacked) and are then inserted in a corresponding box.

Stickpacks, on the other hand, are wrappers obtained from portions of film made of a heat-weldable material, cut from a reel, which are wound about the product to be packaged to form tubular elements, which tubular elements are subsequently heat-welded longitudinally and at two heads thereof, thus forming tubular sachets that are sealed on three sides.

As with the blister packs, the stickpacks are grouped with one another, for example arranged one flanking another, to form a group of packs which is then inserted in a relative box.

In this sector, given the particular type of products, which are frequently identifiable with relative codes representative of the characteristics thereof, the need is increasingly and progressively perceived to be able to keep a trace of the packs of products once packed internally of respective containers or boxes.

At present, a mode used is to apply a tracing code to the container or box in which groups of packs of products are inserted.

In this way, the container or box can be traced once boxed, together with other containers or boxes, inside a respective boxing carton and also, subsequently, following the sales and marketing path thereof.

However, at present, it is not possible also to put a trace on the single packs of products which are inserted inside a given container or box, a circumstance that would enable knowing which particular and specific packs of products have been inserted inside a given and particular container or box.

This issue is substantially triggered by the modalities with which the blister packs and stickpacks are realised, which require particular configurations of the packaging machines, and are also due to the high production velocity, which make it difficult, if not impossible, to read or identify any reference codes applied on the packages, which codes provide an identification of the characteristics and types of the packed products.

For example, in blister-packing machines, the blister packs, once cut from the respective strips, are stacked one on another internally of a vertical store, from which the blister packs are inferiorly extracted in groups by means of a conveyor belt.

In other cases, the blister packs are transported by suction conveyors, or conveyors that comprise retaining elements of opposite sides of the blister packs which act bilaterally of the packages to hold them during the transport.

The same issues are encountered with stickpacks too.

Therefore, it is impossible to carry out an acquisition of any data applied on the packages, and identifying the products packed therein, before grouping them and inserting them in a respective box or container.

Thus, at present it is not possible to carry out a serialisation of the blister packs or the stickpacks before they are grouped and after they are packed in respective boxes; in substance, then, it is not possible to then trace a given particular group of blister packs or stickpacks once inserted in a respective box.

SUMMARY OF THE INVENTION

The aim of the present invention is therefore to describe a method and a system for managing the serialisation and tracing of packs of products, of the type for pharmaceutical, parapharmaceutical, cosmetic or food use packed in blister packs or in stickpacks, which are to be grouped and inserted in a respective container able to obviate the drawbacks set out in the foregoing.

In particular, the aim of the present invention is to provide a method and a system able to acquire data reported on the packs of products, representing the characteristics of the packed products, and serialising the packs of products, forming groupings of packs of products to be inserted in respective containers in such a way as to enable then to be able to trace specific packs of products only on the basis of recognition of the container into which they have been inserted.

The above aims are attained according to the claims.

BRIEF DESCRIPTION OF THE DRAWINGS AND PREFERRED EMBODIMENTS

The characteristics of a preferred, but not exclusive, embodiment of the method and system for managing the serialisation and tracing of packs of products to be grouped in a respective container, provided by the present invention, are described in the following with reference to the appended tables of drawings, in which.

Figures 1, 2, 3:
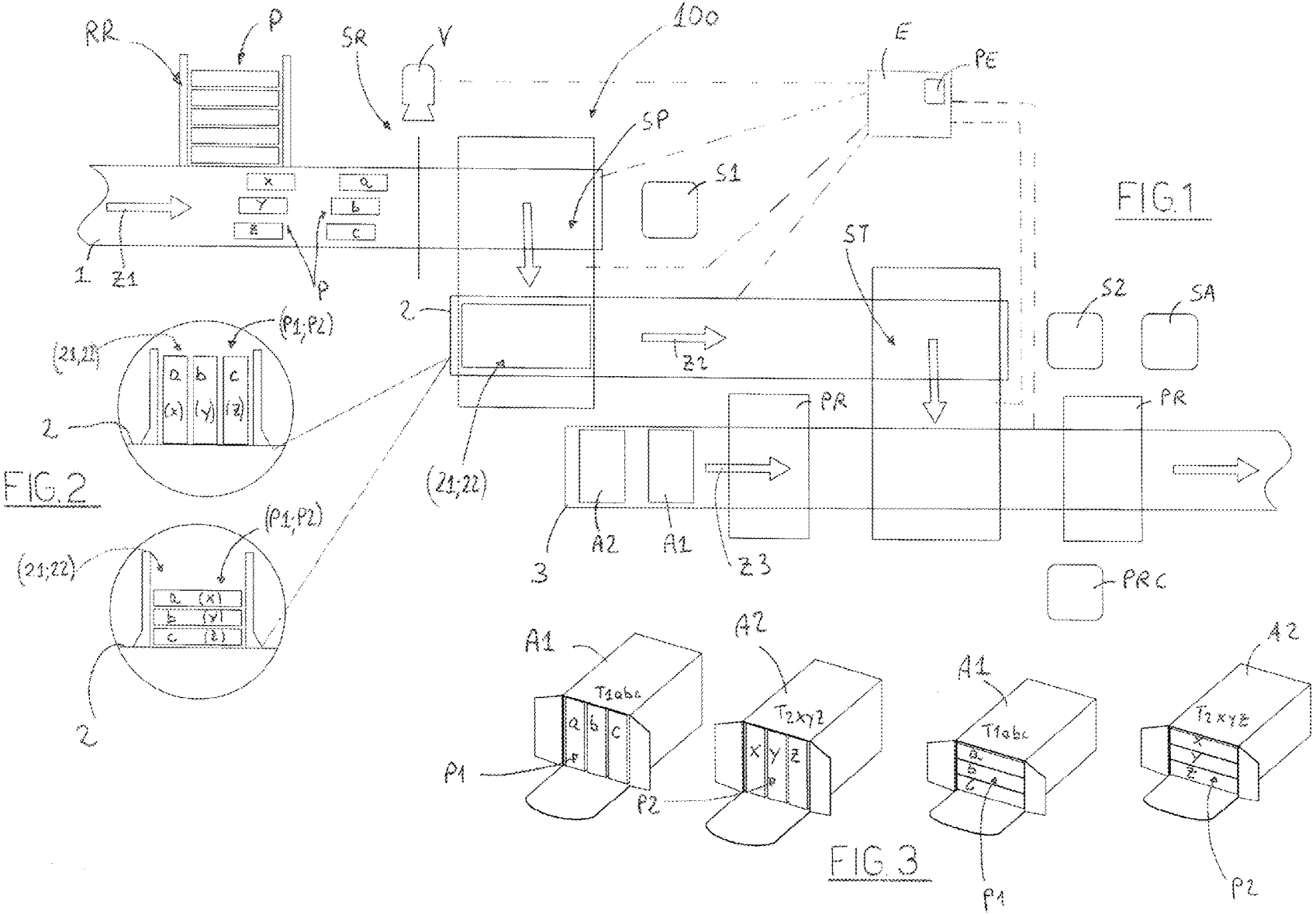
FIG. 1 is a schematic plan view of the system which enables carrying out the method of the invention.
FIG. 2 is a schematic view of a component of the system of the invention in two possible operating modes.

FIG. 3 schematically illustrates, and in respective perspective views, the traceable containers of serialised groups of packages of products obtainable with the method and the system of the invention.

The method that is the object of the present invention is for managing the serialisation and tracing of packs of products, of the type for pharmaceutical, parapharmaceutical, cosmetic or food use packed in blister packs or in stickpacks which are to be gathered into groups of packs to be inserted in respective containers.

The method comprises (see FIG. 1):

arranging a first conveyor means (1);

arranging a second conveyor means (2) comprising a plurality of seats (21, 22) (illustrated for example in FIG. 2) that are configured in such a way as to be able to receive internally thereof a group of packs of products stacked on one another or arranged flanked;

arranging a third conveyor means (3).

The method comprises:

using the first conveyor means (1) to receive packs of products (P) in which each pack of products (P) bears a respective reference code (a, b, c, x, y, z) identifying the specific products packed therein and to advance the packs of products (P) according to a first advancement direction (Z1) in order to cross a detection station (SR) of the reference codes (a, b, c, x, y, z) present on the packs of products (P) and then to a collecting station (SP);

detecting the reference codes (a, b, c, x, y, z) present on the packs of products (P) which are transiting through the detection station (SR) and memorising the respective reference codes (a, b, c, x, y, z), with each of the reference codes (a, b, c, x, y, z) memorised identifying specific products which are packed in the respective pack of products (P).

The method thus comprises:

picking up from the first conveyor means (1) a first series of packs of products (P) transported by the first conveyor means (1) to the collecting station (SP), and for which a respective first series (a, b, c) of reference codes (a, b, c) present thereon has been detected and memorised, and forming a first group (P1) of packs of products internally of a first seat (21) of the second conveyor means (2), stacking the packs of products one on another or arranging the packs of products flanked to one another, and memorising the position of the first seat (21) on the second conveyor means containing the first group (P1) of packs of products having the respective first series (a, b, c) of reference codes (a, b, c);

picking up from the first conveyor means (1) a second series of packs of products (P) transported by the first conveyor means (1) to the collecting station (SP), and for which a respective second series (x, y, z) of reference codes (x, y, z) present thereon have been collected and memorised, and forming a second group (P2) of packs of products internally of a second seat (22) of the second conveyor means (2), stacking the packs of products one on another or arranging the packs of products flanked to one another, and memorising the position of the second seat (22) on the second conveyor means (2) containing the second group (P2) of packs of products having the second series (x, y, z) of reference codes (x, y, z).

The method further comprises:

using the second conveyor means (2) to advance the first seat (21), containing the first group (P1) of packs of products having the respective first series (a, b, c) of reference codes (a, b, c), and the second seat (22), containing the second group (P2) of packs of products having the second series (x, y, z) of reference codes (x, y, z), according to a second advancement direction (Z2) in order to bring the first seat (21) and the second seat (22) to a transfer zone (ST);

using the third conveyor means (3) to advance a first container (A1), destined to receive the first group (P1) of packs of products having the respective first series (a, b, c) of reference codes (a, b, c) and contained in the first seat (21) of the second conveyor means (2), according to a third advancement direction (Z3) in order to bring the first container (A1) to the transfer zone (ST);

using the third conveyor means (3) to advance a second container (A2), destined to receive the second group (P2) of packs having the respective second series (x, y, z) of reference codes (x, y, z) contained in the second seat (22) of the second conveyor means (2), according to the third advancement direction (Z3) in order to bring the second container (A2) to the transfer zone (ST).

The method thus comprises:

using the memorised position of the first seat (21) on the second conveyor means (2) to identify the position of the first seat (21) in the transfer zone (ST) and transferring the first group (P1) of packs of products having the respective first series (a, b, c) of reference codes (a, b, c) from the first seat (21) of the second conveyor means (2) into the first container (A1);

using the memorised position of the second seat (22) on the second conveyor means (2) to identify the position of the second seat (22) in the transfer zone (ST) and transferring the second group (P2) of packs of products having the respective second series (x, y, z) of reference codes (x, y, z) from the second seat (22) of the second conveyor means (2) into the second container (A2).

Lastly the method:

before or after transferring the first group (P1) of packs of products into the first container (A1), comprises applying on the first container (A1) a first tracing code (T1*abc*) bearing a first datum representing each reference code (a, b, c) of the first series (a, b, c) of reference codes (a, b, c) which had been memorised and which are present in the respective packs of products of the first group (P1) of packs of products so as to indicate and recognise the specific products packed therein; before or after transferring the second group (P2) of packs of products into the second container (A2), the method comprises applying on the second container (A2) a second tracing code (T2*xyz*) bearing a second datum representing each reference code of the second series (x, y, z) of the second series of reference codes (x, y, z) which had been memorised and which are present in the respective packs of products of the second group (P2) of packs of products so as to indicate and recognise the specific products packed therein.

With the term "applying a tracing code" is meant that the method can comprise directly applying on the first container (A1) a first tracing code (T1*abc*) and on the second container (A2) a second tracing code (T2*xyz*), for example by printing the tracing codes directly on the containers, or it can include applying, for example by printing, the tracing codes on a support element, such as, for example a label, which will then be applied to the respective container.

In this way, with the method of the invention, the containers will bear a respective tracing code reporting information relative to the respective and various packs of products inserted therein, and therefore it will be possible to know, without having to open the containers, the specific products present in the packs of products contained therein.

In this regard, the method comprises, once applied on and associated a first tracing code (T1*abc*) to the first container (A1) and once applied on and associated a second tracing code (T2*xyz*) to the second container (A2), memorising the association between the first tracing code (T1*abc*) and the first container (A1) and memorising the association between the second tracing code (T2*xyz*) and the second container (A2).

Thus, from a simple reading of the first or second tracing code it will be possible to immediately know and identify the reference codes of the specific products present in the packs of products internally of the first and second container, and thus know which specific products are present internally of the containers.

Using the first conveyor means, with the method of the invention it is possible to receive the packs of products, for example blister packs or stickpacks, containing products for pharmaceutical, parapharmaceutical, cosmetic or food use, directly from the respective packaging machines, and transport them, singly or in groups, to cross the detection station, thus enabling the detecting means included in the detection station (for example constituted by video cameras or other types of acquiring devices) to detect the reference codes applied on the respective packs of products during the production thereof.

Using the second conveyor having a plurality of seats configured to receive groups of packages of products, stacked on one another or arranged flanked to one another, with the method of the invention it is possible to gather, at the collecting station, using gripping means (for example constituted by an anthropomorphic robot, or other types of collecting devices), the packs of products for which the respective reference codes have been detected and memorised (either singly or in groups) and transfer the packs of products internally of the seats of the second conveyor means, forming a group of packs.

Having memorised the various reference codes of the respective packs of products inserted and grouped (or stacked or arranged one flanked to the others) in a respective seat of the second conveyor means, and having memorised the position of the seat on the second conveyor means, with the method of the invention the third conveyor means can then be used to transport a container to the transfer zone to which the seat, for which the position on the second conveyor means is known, is also transported, and in which a group of packages of products for which the respective reference codes have been memorised is present.

In this way, with the method of the invention, it is possible to carry out the transfer of the group of packages of products into a respective container, knowing, as they are memorised, the respective reference codes of each of the packs of products, and therefore, it will be possible to apply to this particular container a respective tracing code reporting information on each of the reference codes of the respective packs of products inserted therein (see for example FIG. 3).

Thus, the contents of each container, i.e. the specific contents of each of the packs of products inserted therein, can be successively easily traceable simply by reading the tracing code applied to the container.

The first conveyor means, the second conveyor means and the third conveyor means, according to the method of the invention, are activated in a coordinated manner with one another in such a way as to allow, when the packs of products reach the collecting station, the collecting of the packs of products from the first conveyor means and the formation of the groups of packs of products in the seats of the second conveyor means, and the transferring with the second conveyor means of the seats containing the groups of packages of products into the transfer zone in conjunction with respective containers transported by the third conveyor means so as to enable transfer of the groups of packs into the corresponding containers.

Other and further preferred and advantageous aspects of method of the invention are described in the following.

In a first preferred aspect, the method comprises carrying out a step of rejecting packs of products for which the respective reference codes detected in the detection station have been recognised as defective or not valid, wherein the step of rejecting comprises picking up the packs of products with a defective or not valid code from the first conveyor means and releasing the packs of products into a respective first rejects station (S1) of defective packs of products.

In this case, the method can comprise carrying out a step of deleting the memorised reference codes relative to the packs of products which are rejected and released in the first rejects station (S1).

In a further preferred aspect, the method of the invention comprises carrying out a step of collecting groups of packs of products present in the seats of the second conveyor means (2) in the event of faults or halting of the advancement of the second conveyor means (2) and/or of the third conveyor means (3), wherein the step of collecting the groups of packs comprises, once a group of packs has been picked up from a respective seat of the conveyor means (2), carrying out, in a case wherein the packs of products are intact, a step of depositing the group of packs of products in a recovery station (RR) arranged flanked to the first conveyor means (1) and upstream of the detection station (SR) with respect to a first advancement direction (Z1) of the first conveyor means (1), or carrying out, in a case in which one or more of the packs of products is damaged, a step of releasing the group of packs of products at a rejects collection station (S2).

In particular, to carry out the step of depositing the group of packs of products in the recovery station (RR), the method can comprise a first step of depositing the group of packs of products in a temporary storage station (SA) and a second step of collecting the group of packs of products from the temporary storage station (SA) and of depositing the group of packs of products in the recovery station (RR).

In a further preferred aspect, the method can include carrying out a step of deleting the memorised reference codes relative to the packs of products of the group of packages of products which are to be deposited in the recovery station (RR), as the packs of products, once deposited in the recovery station (RR), will be successively repositioned on the first conveyor means and then will be transited through the detection station (SR).

A step of deleting the memorised reference codes relative to the packs of products can also be included, which packs of products are released into the second rejects collection station (S2) as they are damaged.

In this way, a superfluous accumulation of memorised data is avoided.

On the basis of a further preferred aspect, the method of the invention comprises carrying out a step of collecting a container into which a group of packages of products from the third conveyor means (3) has been inserted, in the event in which the container is damaged or in the case in which the tracing code applied thereon is not complete or is defective, and releasing the container in a rejects position (PRC) of the defective containers.

In this case too, the method can comprise deleting the memorised data relative to the reference codes relating to the packs of products present internally of the containers which are rejected and released in the rejects position (PRC), as well as deleting the data relative to the tracing codes of the containers.

FIG. 1 illustrates, schematically and in its entirety, the system (100) utilisable for carrying out the above-described method, for managing the serialisation and tracing of packs of products, of the type for pharmaceutical, parapharmaceutical, cosmetic or food use packed in blister packs or in stickpacks which are to be gathered into groups of packs to be inserted in respective containers.

The system (100) comprises:

a first conveyor means (1), activatable according to a first advancement direction (Z1), designed for receiving packs of products (P) on each of which a respective reference code (a, b, c, x, y, z) is present identifying the specific packed products in each thereof and advancing the packs of products (P) in the first advancement direction (Z1);

a second conveyor means (2), activatable according to a second advancement direction (Z2), comprising a plurality of seats (21, 22) that are configured in such a way as to be able to receive internally thereof a group of packs of products stacked on one another or arranged flanked;

a third conveyor means (3), activatable according to a third advancement direction (Z3), for receiving containers (A1, A2) internally of which groups of packs of products are to be inserted and advancing the containers (A1, A2) in the third advancement direction (Z3).

For example, the three conveyor means can be arranged parallel to one another, and partially flanked, as illustrated in FIG. 1, but other and different reciprocal arrangements can be included according to the particular needs that might emerge in the coupling between the packaging machines for production of blister packs or stickpacks, and the boxing lines of the containers containing the packs of products.

The system (100) therefore comprises:

a detection station (SR) comprising detecting means (V) of the reference codes (a, b, c, x, y, z) present on the packs of products (P); the detecting means (V) are configured and arranged with respect to the first conveyor means (1) in a position such as to be able to detect and memorise the reference codes (a, b, c, x, y, z) present on the respective packs of products (P) transported by the first conveyor means (1) in the first advancement direction (Z1);

a collecting station (SP), arranged downstream of the detection station (SR) with respect to the first advancement direction (Z1), comprising gripping means operating in an area interposed between the first conveyor means (1) and the second conveyor means (2).

The gripping means are configured to pick up a first series of packs of products (P) transported by the first conveyor means (1) to the collecting station (SP), and for which a respective first series (a, b, c) of reference codes (a, b, c) present thereon has been collected and memorised, and forming a first group (P1) of packs of products internally of a first seat (21) of the second conveyor means (2), transported by the second conveyor means (2), stacking the packs of products one on another or arranging the packs of products flanked to one another, and picking up from the first conveyor means (1) a second series of packs of products (P) transported by the first conveyor means (1) to the collecting station (SP), and for which a respective second series (x, y, z) of reference codes (x, y, z) present thereon have been collected and memorised, and forming a second group (P2) of packs of products internally of a second seat (22) of the second conveyor means (2), stacking the packs of products one on another or arranging the packs of products flanked to one another.

The gripping means of the collecting station (SP) can be constituted by an anthropomorphic robot, or other types of collecting devices normally used for picking up and releasing packs of products, such as blister packs or stickpacks. The detecting means (V) can be constituted by a videocamera or other data and/or image acquiring devices.

The system (100) further comprises a transfer station (ST), arranged downstream of the position in which the gripping means of the collecting station (SP) operate with respect to the second advancement direction (Z2) of the second conveyor (2), comprising transfer means operating in an area interposed between the second conveyor means (2) and the third conveyor means (3).

The third conveyor means (3) is configured to advance a first container (A1), destined to receive the first group (P1) of packs of products having the respective first series (a, b, c) of reference codes (a, b, c) and contained in the first seat (21) of the second conveyor means (2), according to a third advancement direction (Z3) in order to bring the first container (A1) to the transfer zone (ST) so that the transfer means transfer the first group (P1) of packs of products having the respective first series (a, b, c) of reference codes (a, b, c) from the first seat (21) of the second conveyor means (2) into the first container (A1).

The third conveyor means (3) is further configured to advance a second container (A2), destined to receive the second group (P2) of packs having the respective second series (x, y, z) of reference codes (x, y, z) contained in the second seat (22) of the second conveyor means (2), according to the third advancement direction (Z3) in order to bring the second container (A2) to the transfer zone (ST) so that the transfer means transfer the second group (P2) of packs of products having the second series (x, y, z) of reference codes (x, y, z) from the respective second seat (22) of the second conveyor means (2) into the second container (A2).

The transfer means of the transfer station (ST) can be constituted by pusher elements translatable for abutting the a group of packs present in a seat of the second conveyor means and pushing them internally of a respective container present on the third conveyor means.

The system (100) comprises a printing station (PR), arranged upstream or downstream of the transfer station (ST) with respect to the third advancement direction (Z3) of the third conveyor means (3).

The printing station (PR) is configured to apply on the first container (A1) a first tracing code (T1*abc*) bearing a first datum representing each reference code (a, b, c) of the first series (a, b, c) of reference codes (a, b, c) which had been memorised and which are present in the respective packs of products of the first group (P1) of packs of products, and configured to apply on the second container (A2) a second tracing code (T2*xyz*) bearing a second datum representing each reference code (x, y, z) the second series (x, y, z) of reference codes (x, y, z) which had been memorised and which are present in the packs of products of the second group (P2) of packs of products.

The printing station (PR) can be configured to print the tracing codes directly onto the containers, or to print the tracing codes on respective support elements, such as for example labels, which will then be applied, for example by gluing, to the containers.

The system (100) is also provided with an electronic control processor (E), interfaced with the first conveyor means (1), the second conveyor means (2) and the third conveyor means (3), with the detecting means (V) of the detection station (SR), with the gripping means of the collecting station (SP), with the transfer means of the transfer station (ST), with the printing station (PR).

The electronic control processor (E) comprises a computer program (PE) which is programmed and configured to activate the first conveyor means (1), the second conveyor means (2) and the third conveyor means (3), the detecting means (V) of the detection station (SR), the gripping means of the collecting station (SP), the transfer means of the transfer station (ST) and the printing station (PR) to carry out the steps of the method of the invention as described in the foregoing.

Other and further preferred aspects of system (100) of the invention are described in the following.

The system (100) can comprise a first rejects station (S1) destined to receive packs of products for which the respective reference codes detected by the detecting means (V) in the detection station (SR) have been recognised as defective or not valid.

In this case, for example, the gripping means of the collecting station (SP) can further be configured to pick up from the first conveyor means (1) the packs of products for which the respective codes have been recognised as defective or not valid and release the packs of products into the first rejects station (S1).

The computer program can be configured in such a way as to delete the memorised reference codes relative to the defective packs of products which are picked up by the first conveyor means and released in the first rejects station (S1).

The system (100) also comprises a recovery station (RR) arranged flanked to the first conveyor means (1) and upstream of the detection station (SR) with respect to a first advancement direction (Z1) of the first conveyor means (1), destined to receive the intact groups of packs of products present internally of seats of the second conveyor means (2) which have not been transferred internally of a respective container present on the third conveyor means (3), in the event of faults or halting of the advancement of the second conveyor means (2) and/or of the third conveyor means (3), and also a rejects collection station (S2) destined to receive the defective or damaged groups of packs of products present internally of seats of the second conveyor means (2) which have not been transferred internally of a respective container present on the third conveyor means (3), in the event of faults or halting of the advancement of the second conveyor means (2) and/or of the third conveyor means (3).

The transfer of the groups of packages of products into the recovery station (RR) or into the rejects collection station (S2) can be carried out automatically, by relative pick-up and release means, or also manually by an operator in the case of shutdown of the second and third conveyor means.

In particular, the system (100) can be made in such a way as also to comprise a temporary storage station (SA) destined to temporarily receive the intact groups of packs of products present internally of seats of the second conveyor means (2), which have not been transferred internally of a respective container present on the third conveyor means (3), in the event of faults or halting of the advancement of the second conveyor means (2) and/or of the third conveyor means (3), before the successive transfer thereof to the recovery station (RR).

In this case too, the transfer of the groups of packages of products into the temporary storage station (SA), and from there to the recovery station (RR), can be carried out in an automatic way, by special pick-up and release means, or also manually by an operator.

The computer program can be configured in such a way as to delete the reference codes memorised and relative to the packs of products which must be deposited in the recovery station (RR), as the packs of products, once deposited in the recovery station (RR), will be successively repositioned on the first conveyor means and then will be transited through the detection station (SR).

In the same way, a step of deleting the memorised reference codes relative to the packs of products can also be included, which packs of products are released into the second rejects collection station (S2) as they are damaged.

In this way, a superfluous accumulation of memorised data is avoided.

Lastly, the system (100) can also comprise a rejects position (PRC) destined to receive a container in which a group of packs of products has been inserted, in a case where the container is damaged or in the case in which the tracing code applied thereon is not complete or is defective.

As mentioned in the foregoing, the computer program can be configured in such a way as to delete the memorised data relative to the reference codes relating to the packs of products present internally of the containers which are rejected and released in the rejects position (PRC), as well as deleting the data relative to the tracing codes of the containers.

The invention claimed is:

1. A method for managing serialization and tracing of packs of products, of a type for pharmaceutical, parapharmaceutical, cosmetic or food use packed in blister packs or in stickpacks which are to be gathered in groups of packs to be inserted in respective containers, comprising:

arranging a first conveyor means (1);

arranging a second conveyor means (2) comprising a plurality of seats (21, 22) that are configured in such a way as to be able to receive internally thereof a group of packs of products stacked on one another or arranged flanked;

arranging a third conveyor means (3);

and comprising steps of:

using the first conveyor means (1) to receive packs of products (P) in which each pack of products bears a respective reference code (a, b, c, x, y, z) identifying specific products packaged therein and to advance the packs of products (P) according to a first advancement direction (Z1) in order to cross a detection station (SR)

of the reference codes (a, b, c, x, y, z) present on the packs of products (P) and to a collecting station (SP);

detecting the reference codes (a, b, c, x, y, z) present on the packs of products (P) which are transiting through the detection station (SR) and memorizing the respective reference codes (a, b, c, x, y, z), with each of the reference codes (a, b, c, x, y, z) memorised identifying specific products which are packed in the respective pack of products (P);

picking up from the first conveyor means (1) a first series of packs of products (P) transported by the first conveyor means (1) to the collecting station (SP), and for which a respective first series (a, b, c) of reference codes (a, b, c) present thereon has been detected and memorised, and forming a first group (P1) of packs of products internally of a first seat (21) of the second conveyor means (2), stacking the packs of products one on another or arranging the packs of products flanked to one another, and memorizing the position of the first seat (21) on the second conveyor means containing the first group (P1) of packs of products having the respective first series (a, b, c) of reference codes (a, b, c);

picking up from the first conveyor means (1) a second series of packs of products (P) transported by the first conveyor means (1) to the collecting station (SP), and for which a respective second series (x, y, z) of reference codes (x, y, z) present thereon have been collected and memorised, and forming a second group (P2) of packs of products internally of a second seat (22) of the second conveyor means (2), stacking the packs of products one on another or arranging the packs of products flanked to one another, and memorizing the position of the second seat (22) on the second conveyor means (2) containing the second group (P2) of packs of products having the respective second series (x, y, z) of reference codes (x, y, z);

using the second conveyor means (2) to advance the first seat (21), containing the first group (P1) of packs of products having the respective first series (a, b, c) of reference codes (a, b, c), and the second seat (22), containing the second group (P2) of packs of products having the respective second series (x, y, z) of reference codes (x, y, z), according to a second advancement direction (Z2) in order to bring the first seat (21) and the second seat (22) to a transfer zone (ST);

using the third conveyor means (3) to advance a first container (A1), destined to receive the first group (P1) of packs of products having the respective first series (a, b, c) of reference codes (a, b, c) and contained in the first seat (21) of the second conveyor means (2), according to a third advancement direction (Z3) in order to bring the first container (A1) to the transfer zone (ST);

using the third conveyor means (3) to advance a second container (A2), destined to receive the second group (P2) of packs having the respective second series (x, y, z) of reference codes (x, y, z) contained in the second seat (22) of the second conveyor means (2), according to the third advancement direction (Z3) in order to bring the second container (A2) to the transfer zone (ST);

using the memorised position of the first seat (21) on the second conveyor means (2) to identify the position of the first seat (21) in the transfer zone (ST) and transferring the first group (P1) of packs of products having the respective first series (a, b, c) of reference codes (a, b, c) from the first seat (21) of the second conveyor means (2) into the first container (A1);

using the memorised position of the second seat (21) on the second conveyor means (2) to identify the position of the second seat (22) in the transfer zone (ST) and transferring the second group (P2) of packs of products having the respective second series (x, y, z) of reference codes (x, y, z) from the second seat (22) of the second conveyor means (2) into the second container (A2);

wherein, before or after transferring the first group (P1) of packs of products into the first container (A1), the method comprises applying on the first container (A1) a first tracing code (T1 *abc*) bearing a first datum representing each reference code (a, b, c) of the first series (a, b, c) of reference codes (a, b, c) which had been memorised and which are present in the respective packs of products of the first group (P1) of packs of products so as to indicate and recognize the specific products packed therein;

wherein, before or after transferring the second group (P2) of packs of products into the second container (A2), the method comprises applying on the second container (A2) a second tracing code (T2 *xyz*) bearing a second datum representing each reference code (x, y, z) of the second series (x, y, z) of reference codes (x, y, z) which had been memorised and which are present in the respective packs of products of the second group (P2) of packs of products so as to indicate and recognize the specific products packed therein, wherein the method comprises, once a first tracing code (T1 *abc*) has been applied on and associated to the first container (A1) and once a second tracing code (T2 *xyz*) has been applied on and associated to the second container (A2), memorizing the association between the first tracing code (T1 *abc*) and the first container (A1) and memorizing the association between the second tracing code (T2 *xyz*) and the second container (A2).

2. The method as claimed in claim 1, comprising carrying out a step of rejecting packs of products for which the respective reference codes detected in the detection station have been recognized as defective or not valid, wherein the step of rejecting comprises picking up the packs of products with a defective or not valid code from the first conveyor means and releasing the packs of products into a respective first rejects station (S1) of defective packs of products.

3. The method as claimed in claim 2, comprising carrying out a step of deleting the memorised reference codes relative to the packs of products which are rejected and released in the first rejects station (S1).

4. The method as claimed in claim 1, comprising carrying out a step of collecting groups of packs of products present in the seats of the second conveyor means (2) in the event of faults or halting of the advancement of the second conveyor means (2) and/or of the third conveyor means (3), wherein the step of collecting the groups of packs comprises, once a group of packs has been picked up from a respective seat of the conveyor means (2), carrying out, in a case wherein the packs of products are intact, a step of depositing the group of packs of products in a recovery station (RR) arranged flanked to the first conveyor means (1) and upstream of the detection station (SR) with respect to a first advancement direction (Z1) of the first conveyor means (1), or carrying out, in a case in which one or more of the packs of products is damaged, a step of releasing the group of packs of products at a rejects collection station (S2).

5. The method as claimed in claim 4, wherein the step of depositing the group of packs of products in the recovery station (RR) comprises a first step of depositing the group of packs of products in a temporary storage station (SA) and a second step of collecting the group of packs of products from the temporary storage station (SA) and of depositing the group of packs of products in the recovery station (RR).

6. The method as claimed in claim 4, comprising carrying out, before carrying out a step of repositioning the packs of products contained in the recovery station (RR) on the first conveyor means (1), a step of deleting the memorised reference codes relative to the packs of products present in the recovery station (RR) or to be deposited in the recovery station (RR).

7. The method as claimed in claim 1, comprising a step of collecting a container in which a group of packs of products has been inserted from the third conveyor means (3), in a case where the container is damaged or in a case in which the tracing code applied thereon is not complete or is defective, and a step of releasing the container in a rejects position (PRC) of the defective containers.

8. The method as claimed in claim 7, which comprises carrying out a step of deleting the memorised data relative to the reference codes relating to the packs of products present internally of the containers which are rejected and released in the rejects position (PRC), as well as deleting the data relative to the tracing codes of the containers.

9. A system (100) for carrying out the method of claim 1, for managing the serialization and tracing of packs of products, of the type for pharmaceutical, parapharmaceutical, cosmetic or food use packed in blister packs or in stickpacks which are to be gathered in groups of packs to be inserted in respective containers, comprising:

a first conveyor means (1), activatable according to a first advancement direction (Z1), for receiving packs of products (P) on which a respective reference code (a, b, c, x, y, z) is present identifying the specific packed products in each, and advancing the packs of products (P) in the first advancement direction (Z1);

a second conveyor means (2), activatable according to a second advancement direction (Z2), comprising a plurality of seats (21, 22) that are configured in such a way as to be able to receive internally thereof a group of packs of products stacked on one another or arranged flanked;

a third conveyor means (3), activatable according to a third advancement direction (Z3), for receiving containers (A1, A2) internally of which groups of packs of products are to be inserted and advancing the containers (A1, A2) in the third advancement direction (Z3);

a detection station (SR) comprising detecting means (V) of the reference codes (a, b, c, x, y, z) present on the packs of products (P), the detecting means (V) being configured and arranged with respect to the first conveyor means (1) in a position such as to be able to detect and memorize the reference codes (a, b, c, x, y, z) present on the respective packs of products (P) transported by the first conveyor means (1) in the first advancement direction (Z1);

a collecting station (SP), arranged downstream of the detection station (SR) with respect to the first advancement direction (Z1), comprising gripping means operating in an area interposed between the first conveyor means (1) and the second conveyor means (2), wherein the gripping means are configured to pick up a first series of packs of products (P) transported by the first conveyor means (1) to the collecting station (SP), and for which a respective first series (a, b, c) of reference codes (a, b, c) present thereon has been collected and memorised, and to form a first group (P1) of packs of products internally of a first seat (21) of the second conveyor means (2) transported by the second conveyor means (2), stacking the packs of products one on another or arranging the packs of products flanked to one another, and to pick up from the first conveyor means (1) a second series of packs of products (P) transported by the first conveyor means (1) to the collecting station (SP), and for which a respective second series (x, y, z) of reference codes (x, y, z) present thereon has been collected and memorised, and to form a second group (P2) of packs of products internally of a second seat (22) of the second conveyor means (2), stacking the packs of products one on another or arranging the packs of products flanked to one another, a transfer station (ST), arranged downstream of the position in which the gripping means of the collecting station (SP) operate with respect to the second advancement direction (Z2) of the second conveyor (2), comprising transfer means operating in an area interposed between the second conveyor means (2) and the third conveyor means (3), wherein the third conveyor means (3) is configured to advance a first container (A1), destined to receive the first group (P1) of packs of products having the respective first series (a, b, c) of reference codes (a, b, c) and contained in the first seat (21) of the second conveyor means (2), according to a third advancement direction (Z3), in order to bring the first container (A1) to the transfer zone (ST) so that the transfer means transfer the first group (P1) of packs of products having the respective first series (a, b, c) of reference codes (a, b, c) from the first seat (21) of the second conveyor means (2) into the first container (A1);

wherein the third conveyor means (3) is configured to advance a second container (A2), destined to receive the second group (P2) of packs having the respective second series (x, y, z) of reference codes (x, y, z) contained in the second seat (22) of the second conveyor means (2), according to the third advancement direction (Z3) in order to bring the second container (A2) to the transfer zone (ST) so that the transfer means transfer the second group (P2) of packs of products having the respective second series (x, y, z) of reference codes (x, y, z) from the second seat (22) of the second conveyor means (2) into the second container (A2);

a printing station (PR), arranged upstream or downstream of the transfer station (ST) with respect to the third advancement direction (Z3) of the third conveyor means (3), configured to apply on the first container (A1) a first tracing code (T1 *abc*) bearing a first datum representing each reference code (a, b, c) of the first series (a, b, c) of reference codes (a, b, c) which had been memorised and which are present in the respective packs of products of the first group (P1) of packs of products and configured to apply on the second container (A2) a second tracing code (T2 *xyz*) bearing a second datum representing each reference code (x, y, z) of the second series (x, y, z) of reference codes (x, y, z) which had been memorised and which are present in the respective packs of products of the second group (P2) of packs of products;

an electronic control processor (E), interfaced with the first conveyor means (1), the second conveyor means (2) and the third conveyor means (3), with the detecting means (V) of the detection station (SR), with the gripping means of the collecting station (SP), with the transfer means of the transfer station (ST), with the printing station (PR), wherein the electronic control processor (E) comprises a computer program (PE) configured to activate the first conveyor means (1), the second conveyor means (2) and the third conveyor means (3), the detecting means (V) of the detection station (SR), the gripping means of the collecting station (SP), the transfer means of the transfer station (ST) and the printing station (PR) to carry out the steps of the method as claimed in claim 1.

10. The system (100) as claimed in claim 9, comprising a first rejects station (S1) destined to receive packs of products for which the respective reference codes detected by the detecting means (V) in the detection station (SR) have been recognized as defective or not valid, and wherein the gripping means of the collecting station (SP) are further configured to pick up from the first conveyor means (1) the packs of products for which the respective codes have been recognized as defective or not valid and to release the packs of products into the first rejects station (S1).

11. The system (100) as claimed in claim 9, comprising a recovery station (RR) arranged flanked to the first conveyor means (1) and upstream of the detection station (SR) with respect to a first advancement direction (Z1) of the first conveyor means (1), destined to receive the intact groups of packs of products present internally of seats of the second conveyor means (2) which have not been transferred internally of a respective container present on the third conveyor means (3), in the event of faults or halting of the advancement of the second conveyor means (2) and/or of the third conveyor means (3), and comprising a rejects collection station (S2) destined to receive the defective or damaged groups of packs of products present internally of seats of the second conveyor means (2) which have not been transferred internally of a respective container present on the third conveyor means (3), in the event of faults or halting of the advancement of the second conveyor means (2) and/or of the third conveyor means (3).

12. The system (100) as claimed in claim 11, comprising a temporary storage station (SA) destined to temporarily receive the intact groups of packs of products present internally of seats of the second conveyor means (2), which have not been transferred internally of a respective container present on the third conveyor means (3), consequently to faults or halting of the advancement of the second conveyor means (2) and/or of the third conveyor means (3), before the successive transfer thereof to the recovery station (RR).

13. The system (100) as claimed in claim 9, comprising a rejects position (PRC) destined to receive a container in which a group of packs of products has been inserted, in a case where the container is damaged or in a case in which the tracing code applied thereon is not complete or is defective.

* * * * *